US005867963A

United States Patent [19]

Hershey

[11] Patent Number: 5,867,963

[45] Date of Patent: Feb. 9, 1999

[54] TRIMMABLE TRUSS APPARATUS

[75] Inventor: Donald W. Hershey, Glendale, Ariz.

[73] Assignee: Truswal Systems Corporation, Arlington, Tex.

[21] Appl. No.: 935,750

[22] Filed: Sep. 23, 1997

[51] Int. Cl.[6] ..... E04C 3/12

[52] U.S. Cl. ..... 52/729.4; 52/690; 52/693; 52/730.1; 52/730.7

[58] Field of Search ..... 52/729.4, 730.1, 52/730.7, 690, 693

[56] References Cited

U.S. PATENT DOCUMENTS

| | | | |
|---|---|---|---|
| 3,651,612 | 3/1972 | Schmitt | 52/693 |
| 3,849,963 | 11/1974 | Harmon | 52/729.4 |
| 4,207,719 | 6/1980 | Knowles | 52/693 |
| 4,336,678 | 6/1982 | Peters | 52/429.4 |
| 4,435,929 | 3/1984 | Bussell | 52/690 X |
| 4,501,102 | 2/1985 | Knowles | 52/690 |
| 4,525,974 | 7/1985 | Steidle-Sailer et al. | 52/693 |
| 4,862,662 | 9/1989 | Eberle et al. | 52/299 |
| 4,893,961 | 1/1990 | O'Sullivan et al. | 52/729.4 X |
| 5,560,177 | 10/1996 | Brightwall | 52/729.4 |
| 5,592,800 | 1/1997 | Koo et al. | 52/692 |
| 5,649,403 | 7/1997 | Haisch | 52/693 |
| 5,653,080 | 8/1997 | Bergeron | 52/729.4 |

*Primary Examiner*—Carl D. Friedman
*Assistant Examiner*—Beth Aubrey
*Attorney, Agent, or Firm*—W. Kirk McCord

[57] ABSTRACT

An improved trimmable truss apparatus and method are disclosed, the truss having upper and lower plates centrally interconnected by diagonal web members, and each respective end providing a trimmable section comprising extended upper and lower chords creating an opening into which a separate trimmable insert section is inserted, such inserts made either as a separate wooden I-beam section, or as a glued laminated beam section. The associated nailing plates placed adjacent the last vertical member extend outwardly, ie. overlap, a substantial minimum distance onto the trimmable end section, whereby the truss end sections cannot be trimmed too closely to the last vertical member. The final diagonal web member at each respective end is placed in an upwardly-aligned positioned so as to be in tension.

An alternative embodiment is disclosed in which the separate trimmable insert sections are formed from a glued laminated beam. The upper and lower chords for the present improved trimmable truss can be formed as either composite members or as wood components.

20 Claims, 7 Drawing Sheets

TRIMMABLE TRUSS APPARATUS

FIELD OF THE INVENTION

This invention relates to a truss apparatus, and the method for making same, and more particularly, to an improved trimmable truss where one or both ends can be trimmed to a desired length.

BACKGROUND OF THE INVENTION

Trimmable trusses have been used with increasing frequency in certain applications, for example, in light commercial and warehouse buildings, where there is no standard length (ie. stock length) of commercially available trusses. Instead, one or both ends of a longer trimmable truss may be cut-off, ie. trimmed, so that the trimmed truss is of the desired length for a given application. Such trimmable trusses can be inventoried in standard lengths. Such trimmable trusses must be capable of withstanding substantial live, dead, and seismic loading as well as twisting, particularly when used in earthquake-prone areas.

Known prior art trimmable trusses have proved unsatisfactory, particularly in the longer lengths with heavy loads, ie. of approximately 24 feet or more. For example, one known trimmable truss is believed suitable for certain light duty load applications, such as in residential uses of approximately 20 feet or less in length. When they are used for application lengths longer than that, the design of that type known truss is such as to cause it to often twist, deflect, and fail. This is particularly the case when one (or both) trimmable ends of the truss is substantially trimmed away.

Other trimmable trusses are known but also have deficiencies. For example, with one truss the nailing or so-called gusset plates are located within the trimmable area, requiring either their total removal or otherwise preventing the truss from being easily trimmed to a desired specific length (ie. if trimmed where the gusset plates are located).

The present invention overcomes these deficiencies in the prior art by providing a trimmable truss having elongated upper and lower chords which have ends extending beyond the respective final verticals to create a trimmable area at each end. Separate insertable trim members are interconnected between the respective sets of upper and lower chord extension members. The gusset plates used for the last verticals as well as the last diagonal webs are designed to fasten the insertable trim member into the trimmable end section. This is done to preserve, ie. to protect, the integrity of the truss at the respective trimmable ends, and thus, to prevent failure. Further, the respective last diagonal web members are aligned in an upwardly rising position so as to be in tension. This, in turn, allows any remaining (ie. untrimmed) trimmable end section to be in compression, all so that it may accept substantial force loadings placed thereon. In the preferred embodiment, the separate insertable trim members comprise a portion of a so-called wooden, solid web I-beam, a commercially available component having separate upper and lower sub-chord members interconnected by a vertical plywood or particle board (ie. so-called OSB) web member. In an alternative embodiment, the separate insertable trim members comprise a portion of glued laminated beam.

The present improved method of making a trimmable truss includes forming a truss unit having elongated upper and lower chord members interconnected by a series of alternate opposite-aligned diagonal webs (with or without vertical webs); forming the last diagonal web at each end to be in an upwardly rising alignment; inserting final verticals at the respective ends of the series of diagonals; extending the respective upper and lower chords beyond the final verticals; inserting a trim member between the extended chords, each insertable trim member being a portion of either a wooden I-beam or a glued laminated beam; and overlapping gusset plates substantially into the respective trimmable end sections so as to protect the integrity of the truss member adjacent the final vertical.

The present type trimmable truss is aimed at both the residential and commercial/industrial market. The typical truss length required is from 16 feet to 40 feet. In commercial applications, such as used for warehouses or offices, the trusses are typically placed on 16 inches to eight foot centers. They are attached to the supporting structure by hangers using nails or bolts. The typical vertical dimension for the present improved trimmable wooden truss is between 16 and 30 inches high. In residential applications, the present trusses are typically placed on 16 inches to two foot centers.

Thus, it is an object of the present invention to provide an improved trimmable truss which permits either or both its respective ends to be trimmed within limits, and provide structural integrity regardless of the end amount that is trimmed.

It is a further object of the present invention to provide an improved trimmable truss which utilizes separate insertable trim members, having sub-chord members, so as to provide substantial additional structural integrity to the respective trimmable end sections and to the overall truss when trimmed.

The means by which the foregoing and other objects of the present invention are accomplished will be readily understood from the following specification upon reference to the accompanying drawings, in which.

DESCRIPTION OF THE PREFERRED EMBODIMENT

Figure 1:
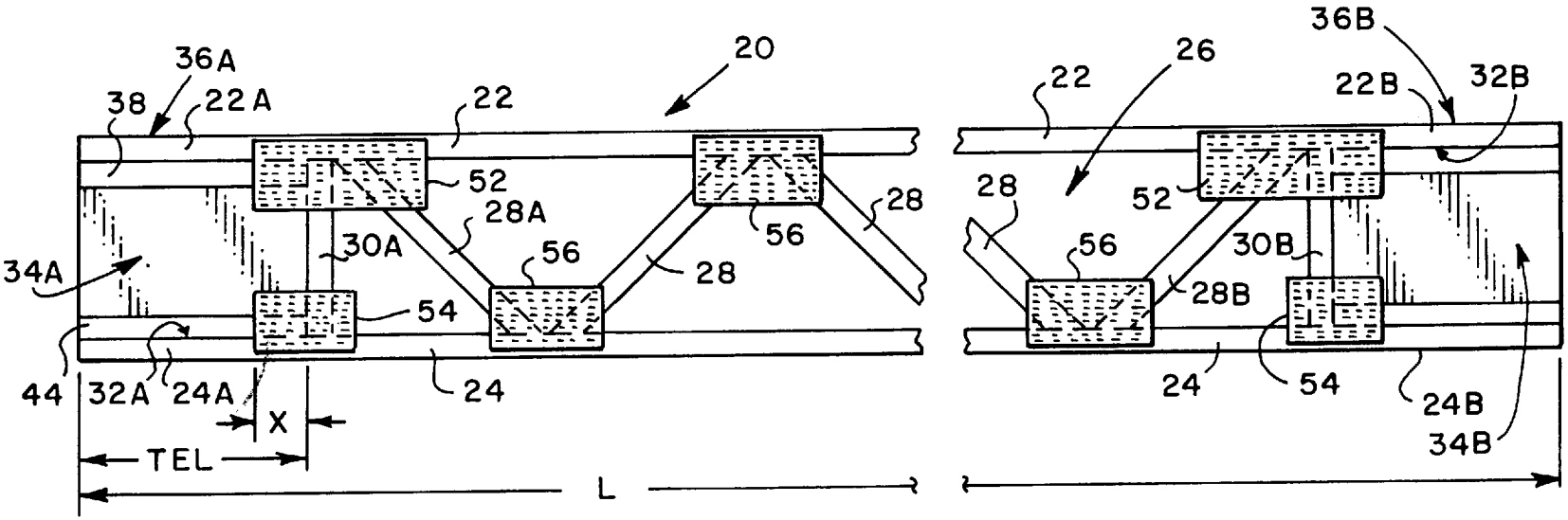
FIG. 1 is a front elevation view of the improved trimmable truss of the present invention.

Having reference to the drawings, wherein like reference numerals indicate corresponding elements, there is shown in FIG. 1 an illustration of an improved trimmable truss, generally denoted by reference numeral 20. Truss 20 comprises upper and lower elongated chord members 22, 24 (which members can either be single members, such as 2 inch by four inch members, as shown in FIG. 1, or as double members—not shown), and an elongated central web truss area, generally noted by reference numeral 26. The web truss area 26 comprises diagonally extending struts or web members 28 (which members can either be single members, such as 2 inch by four inch members, as shown in FIG. 1, or as double members—not shown), each of which are connected at their respective ends to the respective upper and lower chords 22, 24. Outer, or final, vertical members 30A, 30B extend between the upper and lower chords 22, 24 and form the outer respective ends of the central web truss area 26. The respective ends of the upper and lower chords 22, 24 extend outwardly beyond the respective vertical members 30A, 30B, so as to form therebetween respective trimmable end section openings 32A, 32B. Respective insertable trim members, generally denoted by reference numerals 34A, 34B, are inserted into the trimmable section openings 32A, 32B to fit snugly between the respective upper and lower extended chord members 22A, 24A, and between members 22B, 24B.

Figure 2:
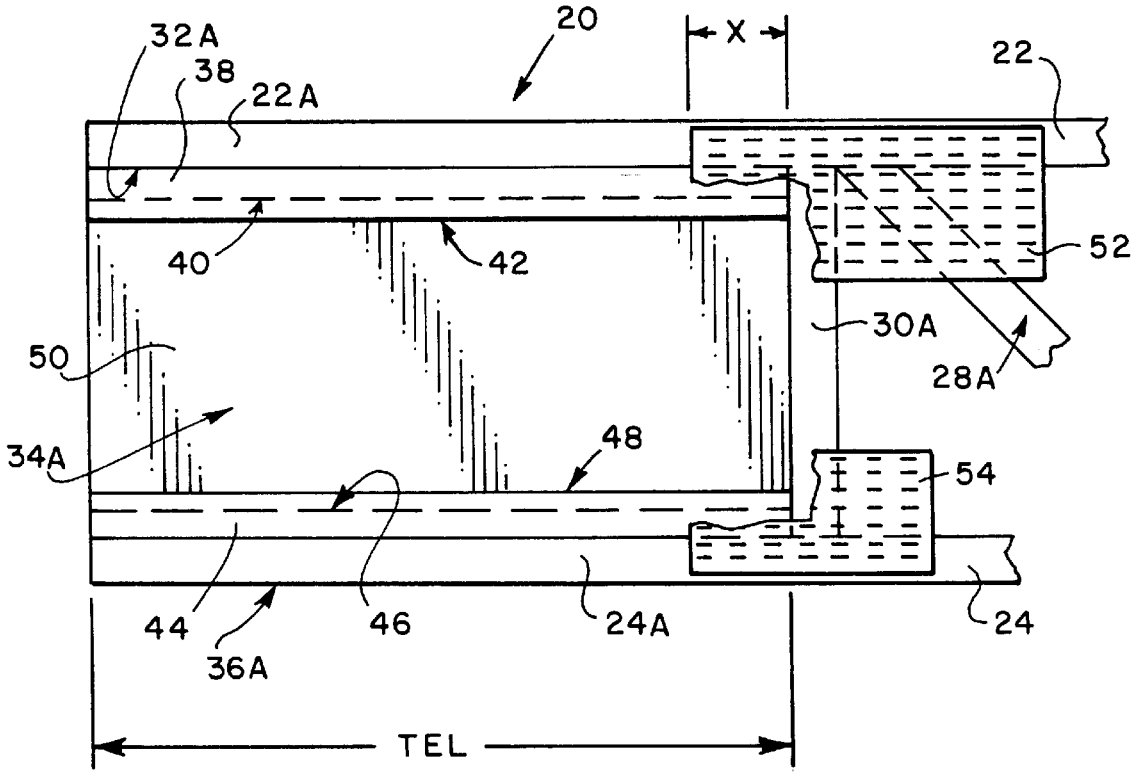
FIG. 2 is an enlarged front elevation view of the left trimmable end section of the improved trimmable truss of FIG. 1.

Turning to the left end of trimmable truss 20, in FIG. 1, it is seen that a trimmable truss end 36A comprises chord extensions 22A, 24A, and the insertable trim member 34A. Similarly, the right trimmable end 36B (see FIG. 1) comprises upper and lower chord extensions 22B, 24B, and the right insertable trim member 34B. As best seen in FIG. 2, the insertable trim member 34A is a separate insertable unit comprising an upper sub-chord 38 having a web-receiving groove 40 formed in the lower surface 42 thereof, and lower sub-chord 44 having a web receiving groove 46 formed in the upper surface 48 thereof, and a vertically-aligned web section 50 having its upper and lower edges securely fixed within the web-receiving groves 40, 46. The other trimmable insert 34B is formed as a duplicate of insert 34A.

As best seen in FIGS. 1 and 2, an elongated upper nailing or so-called metal connector plate 52 is applied to each side of the components making up the truss 20. That is, plate 52 is pressed into the edges of upper chord 22 (including chord extension 22A), the vertical member 30A, the last diagonal web 28A, and the upper sub-chord 38 of trimmable insert 34A. Similarly, a lower metal connector plate 54, which may be somewhat shorter than plate 52, is applied to both sides of the lower portion of truss 20, ie. it is pressed into the edges of the lower chord 24, including chord extension 24A, the vertical 30A, and lower sub-chord 44 of the left trimmable insert 34A.

In practice it has been found that the upper metal connector plate 52 (used at the respective outer ends of the truss 20 adjacent the verticals 30A, 30B) must be of substantial horizontal length (compared to the lower plate 54). The reason for this is that the particular upper joint has several components in tension, and thus, more nail-holding surface area is required to be present for that upper plate 52. One preferred such gusset plate is sold under the name "TEE-LOK" (trademark).

As seen in FIG. 1, yet other metal connector plates 56, similar in size to the lower nailing plate 54, are used on both sides of truss 20 at the various junctions of the respective diagonal webs 28, ie. where they meet along the respective upper and lower chords 22, 24, all in a well known fashion.

In the preferred embodiment, for trusses to be used in commercial and industrial applications, the upper and lower chords 22, 24 are formed as wood-like chords from a suitable composite material, such as formed of a sandwich-type combination of wood, fiber glass, and wood, bonded together by glue. Such a composite is presently obtainable from American Laminators under the trademark FIRP. Alternatively, the composite material can be formed as a bonded combination of wood, a polymeric material such as fiber-reinforced glue, and wood. The cross-sectional dimensions of such composite chords 22, 24 can take several forms, such as two by three inches, two by four inches, two by six inches, and even larger.

The chords 22, 24, can alternately be formed of suitable wooden stock, such as a typical single or double member made from a two by four inch board made of spruce pine fir, Douglas fir, hemlock, or southern yellow pine, for example. In one embodiment made in accordance with the present invention, it was found that both Douglas fir and southern yellow pine are each a preferred wood species for chords 22, 24, primarily because of the inherent nail holding strength for the metal connector plates available from those respective type woods.

If needed for longer lengths of chords 22, 24, whether formed of wooden stock or a composite material, separate sections of chords can be joined together into a long chord by either use of glued finger-joining or by use of metal connector plates.

Figure 3:
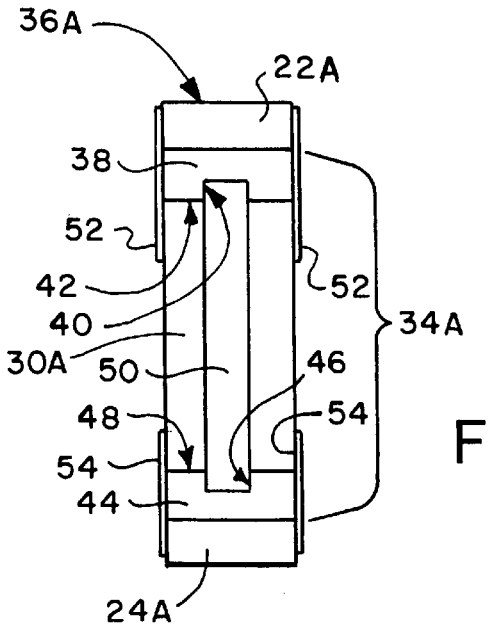
FIG. 3 is an end view of the trimmable end section of FIG. 2.

The trimmable inserts 34A, 34B, can either be especially made, or instead obtained directly from any one of several commercial suppliers. For example, one preferred type of trimmable insert 34A is available from the Georgia-Pacific corporation, as its "GPI Series" (trademark) product known as "WOODIBEAM" (trademark). Another preferred type insert 34A is available from Wadena Saw Mills as American "I" Joist, Series AI-24. Preferably, the upper and lower sub-chords 38, 44, can be formed of Douglas fir or southern yellow pine wood, rather than spruce pine fir, so as to provide better metal connector plate tooth holding power. Further, the web section 50 is formed of a suitable multi-layer plywood, which section can be a single web as shown in FIGS. 1–3, or in some cases a double web section, i.e., 2 pieces of plywood. Alternatively, the web 50 could be formed of a suitable glued wooden flakeboard panel, also known as OSB board. Additionally, for yet further strength for the trimmable insert 34A, the interconnection of the respective edges of web 50 within the web-receiving grooves 40, 46, can take any of a number of different tongue and groove configurations; it is believed that several such special configurations are patented by the respective commercial suppliers of the trimmable insert.

As noted in FIGS. 1 and 2, the outermost diagonal webs 28, namely end webs 28A and 28B, are specifically positioned so as to be in an upward alignment, rather than downward. That is, the upper outermost ends of the outer diagonal webs 28A, 28B are anchored to upper chord 22 adjacent the upper ends of the respective final vertical members 30A, 30B. This is purposely done (as described more fully below) to permit those end diagonals 28A, 28B to be in tension when the truss 20 is loaded in normal use, regardless of how much of the respective trimmable ends 36A, 36B have been removed, ie. trimmed off.

Further, as best seen in FIGS. 1 and 2, the left edges of the upper and lower metal connector plates 52, 54 extend a substantial distance (see reference letter "X" in FIG. 1) onto trimmable insert 34A. That is, upper metal connector plate 52 extends laterally outwardly a substantial distance "X" onto upper chord extension 22A and upper sub-chord 38.

Similarly, lower metal connector plate 54 extends a substantial distance "X" onto lower chord extension 24A and lower sub-chord 44. In the preferred embodiment, the distance "X" by which metal connector plates 52, 54 extend onto trimmable insert 34A is a factor of the trimmable end's length (denoted by reference acronym "TEL" in FIG. 1). More specifically, in the preferred embodiment, the ratio of the distance "X" to the distance "TEL" is in the range from approximately one to three through one to six. Thus, if the "TEL" distance is 24 inches, than the minimum for distance "X" should be in the range from 4 to 8 inches.

This built-in overlapping of the upper and lower metal connector plates 52, 54 onto trimmable end 36A is quite important. This is because the presence of those upper and lower metal connector plates prevents a carpenter or other person who is installing the trimmable truss 20 from inadvertently trimming end 36A too close to the associated vertical member 30A (or vertical 30B at the other end of truss 20). That is, due to the presence of the overlapping of upper and lower metal connector plates 52, 54, at least some portion of trimmable end 36A, and particularly of insertable trim member 34A, will always remain after trimming, ie. end 36A is protected so as to be at least the distance "X" in length. This protection of the trimmable end, in effect, is important, as the remaining untrimmed portion of trimmable end 36A (having at least a minimum length "X") assures the continued physical and structural integrity of that trimmable end 36A of truss 20 (see FIG. 1). This is a substantial advantage over prior art trimmable trusses, where their ends could be trimmed so closely, in fact, even directly up to the edge of the vertical members 30A, 30B, that their structural integrity was substantially diminished, and often resulted in unwanted twisting or even complete failure.

In one embodiment made in accordance with the present invention, the overall length (designated by reference letter "L" in FIG. 1) of the trimmable truss 20 was 36 feet, the height was 22½ inches, the distance "TEL" was 16 inches, the distance "X" was 6 inches. The upper and lower chords 22, 24 were made of Douglas fir wood having a 2 by 4 inch cross-sectional dimension, while the verticals 30A, 30B and their respective diagonal webs 28 (including end diagonals 28A, 28B) were formed of Douglas fir wood having a cross-sectional dimension of 2 by 4 inches. Finally, the separate insertable trim members 34A, 34B were formed of wooden I-beam sections having upper and lower sub-chords 38, 44 formed of southern yellow pine wood with a 2 by 4 inch cross-sectional dimension, while the vertical web 50 was formed of ⅝ inch thick plywood. Preferably, the thickness of the web 50 is in the range of from ⅜ inch to ¾ inch. (Alternately, the web section 50 can be replaced with the ⅝ inch thick layer of so-called flake board material, ie. OSB board.) Also, preferably, the respective edges of web section 50 which are inserted into the web receiving grooves 40, 46 are glued in place.

If needed for given applications, such as in areas of high seismic activity, the size of the vertical web end supports 30A, 30B can be increased either by using a 4 inch by 4 inch wooden member, or two separate abutting two by four inch members. The separate trimmable inserts 34A, 34B are fastened into the insert openings 32A, 32B forming the trimmable end sections 36A, 36B, by the metal connector plates 52, 54. There is no further fastening required during truss manufacturing for incorporation of the trimmable inserts 34A, 34B.

However, if desired for a given truss application, the trimmable inserts 34A, 34B can additionally be glued into the insert openings 32A, 32B by applying glue onto the contact surfaces formed between upper and lower sub-chords 33, 44 and upper and lower chord extension 22A, 24A and 22B, 24B. Glue may also be applied between the respective abutting surfaces of end verticals 30A, 30B and the webs 50 of inserts 34A, 34B.

Yet further, if desired for a given truss application, the trimmable inserts 34A, 34B can also be additionally fastened into the insert openings 32A, 32B by nailing the upper and lower sub-chords 38, 44 to the upper and lower chord extensions 22A, 24A and 22B, 24B. Alternately, this optional nailing can be replaced with the hand application of small metal connector plates (ie. for example, on the order of approximately 1 inch by 3 inch in size) to the outer ends of the trimmable end sections. Each such supplemental metal connector plate would fasten a upper and lower sub-chord 38, 44 to its adjacent upper or lower chord extension 22A, 24A.

In use the above-described construction of the preferred trimmable truss 20, particularly the use of separate insertable trim members 34*a*, 34B, has several advantages. First, contrary to the prior art, there are no web-receiving grooves cut directly into the upper and lower chords 22, 24. The presence of such grooves, as often occurred with those prior art trimmable trusses that had such grooves, creates significant points of inherent failure of the important upper and lower chord members 22, 24. Second, the presence of a separate insertable trim members 34A, 34B provides substantial additional nailing surfaces and cross sectional area at each end of truss 20. This is helpful not only for the metal connector plates 52, 54, but also for any separate nails, screws, bolts, or other fastening devices used to attach the respective trimmed ends of trimmable truss 20 to the associated support structure, such as to bearing walls, poured concrete supports, steel hangers, or the like (none being shown). Third, the use of cut portions of commercially available wooden I-beams, ie. for the trimmable inserts 34A, 34B, makes the construction of the trimmable truss 20 quite economical. Fourth, depending upon a given application's force loading, a trimmable truss 20 having specific desired capabilities can be readily manufactured, ie. by the selection of appropriate trimmable inserts 34A, 34B having different wood types used for the upper and lower sub-chords 38, 44, and of different wood types (ie. plywood, flake board, and so forth) and of a specific thickness to be used for the web section 50. Fifth, the use of separate trimmable inserts 34A, 34B having wooden components (sub-chords 38, 44, and web 50) still permits use of various size and type materials for the chords 22, 24, whether it be wood and polymeric or fiberglass bonded materials (as described above), or traditional wood components.

Because the grooves 40, 46 for web 50 are formed in the sub-chords 38, 44, rather than directly in the chord extensions 22A, 24A, the latter are not inherently weakened such that they can withstand substantial loading. Further, the presence of the sub-chords 38, 44, which provide essentially double the cross sectional dimension for the trimmable end 36A, 36B provide yet additional overall loading capability for truss 20.

Figure 4:
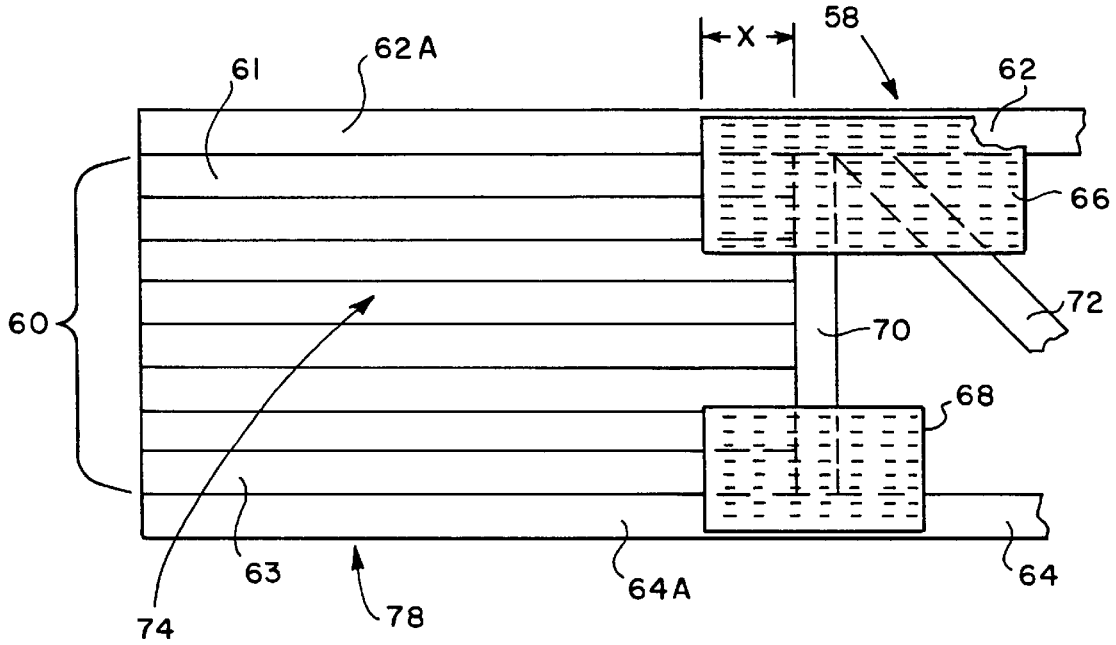
FIG. 4 is an enlarged front elevation view of the left trimmable end section, similar to FIG. 2, but of an alternate embodiment of the present invention.
Figure 5:
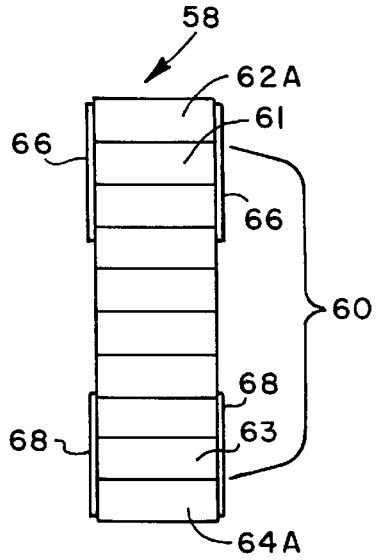
FIG. 5 is an end view of the alternate trimmable end of FIG. 4.

An alternate embodiment of the improved trimmable truss of the present invention is shown in FIGS. 4 and 5, where the outer (ie. left) end of an alternate truss 58 is formed similarly to truss 20, but with an alternate type separate insertable tri=member 60. The truss 58 includes an upper chord 62 and lower chord 64, upper and lower chord extensions 62A, 64A (similar to upper and lower chords 22, 24 and chord extensions 22A, 24A of truss 20), upper and lower metal connector plates 66, 68, a vertical end web member 70, an upwardly aligned diagonal web 72, and an insertable trim member 60.

As seen in FIGS. 4 and 5, the separate trimmable insert 60, instead of being a separate wooden I-beam type insert, such as the insertable trim member 34A of truss 20, comprises a section of a glued laminated beam. Preferably, such a glued laminated beam 60 is of the type formed of individual boards, such as generally denoted by reference member 74 (typically from boards such as two by fours, two by sixes, two by eights, and the like) which are glued together under pressure. In effect, the upper one of such boards acts as an upper sub-chord 61, while the lower one of such boards acts as the lower sub-chord 63, of insertable trim member 60. Thus, the metal connector plates 66, 68 can respectively secure the upper and lower sub-chords 61, 63 to the upper and lower chords 62, 64. One known preferred commercially-available glued laminated beam, from which an insertable trim member 60 can be made, is available from GluLam Tech., under the name GLT (trademark).

This alternate type trimmable truss 58, with a glued laminated beam section used for the insertable trim member 60, can be used in very heavy commercial and industrial applications, ie. where significant additional structural strength of the truss 58 is required, or perhaps where additional surface and cross section dimension is required for installation and fastening to the associated supporting structure.

Further, it will be seen that the end diagonal web 72 of the modified truss 58 is again placed in an upwardly aligned position, relative to the upper end of the vertical 70 and upper chord 62. As with truss 20, this again allows that end diagonal 72 to be placed in tension when the trimmable end 78 of truss 58 is properly loaded (ie. in compression). It will be noted that the outer ends (ie. left ends in FIG. 4) of upper and lower metal connector 66, 68 on truss 58 also extend laterally outwardly onto trimmable end 78 by the distance "X". Again, regardless of the length to which the trimmable end 78 is finally trimmed, the minimum distance "X" of trimmable end 78 will remain (due to the presence of upper and lower extended metal connector plates 66, 68). This prevents trimming too close to the end vertical 70. Thus, the structural integrity of the final trimmed length of trimmable end 78 is still preserved.

It will be understood that the trimmable end 36 of the present truss 20 of FIG. 1, (or the trimmable end 78 of the alternate truss 58 of FIGS. 4 and 5) provide significantly more cross sectional area than that of known prior art trimmable truss ends. This is very advantageous for heavier loading applications. It also is advantageous for fastening purposes. In effect, the various nails, bolts and other attachment means (none shown) can be applied to the upper and lower chords, thereby preserving the integrity of the sub-chords of the trimmable insert end.

Figure 6:
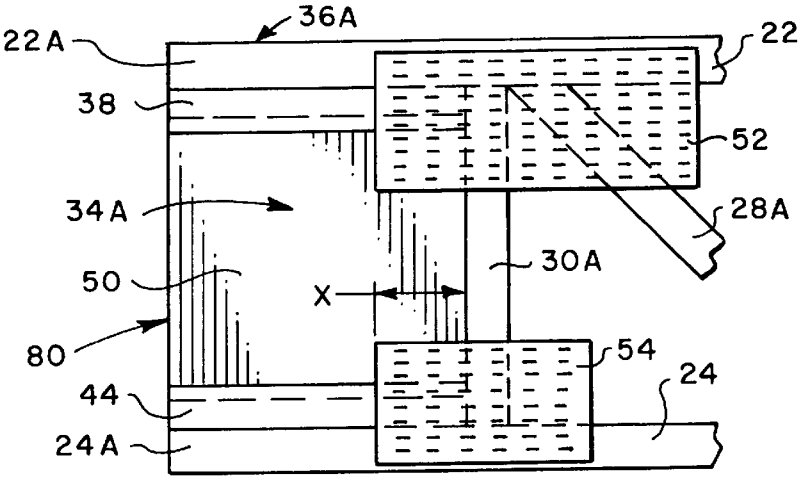
FIG. 6 is an enlarged front elevation view of the tri:able end of the truss of FIG. 1, similar to FIG. 2, and depicting it after it has been trimmed.

There is shown in FIG. 6 a trimmable end 36A (similar to end 36A in FIG. 2) that has been trimmed along its left end 80, such that approximately half the length TEL of that trimmable end 36A has been sawn away. However, as seen, the presence of upper and lower metal connector plates 52, 54 again prevents the final trimmed end 80 from falling within that portion (ie. anywhere along length "X") of trimmable end 34A that is protected, in effect, by such metal connector plates.

Figure 7:
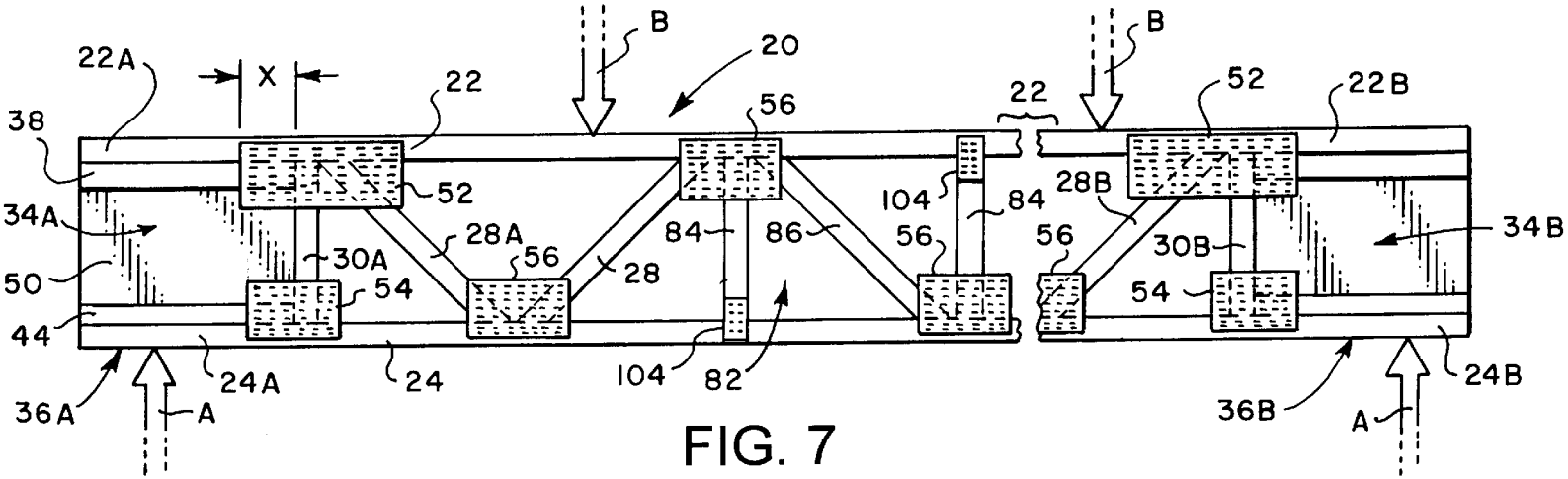
FIG. 7 is a front elevation view similar to FIG. 1, in fragmentary format, and showing the pertinent force loading.

There is seen in FIG. 7 a force-loading diagram of the improved trimmable truss 20. As seen, the upwardly directed force (arrow A in FIG. 7) places the trimmable end 34A in compression when downwardly directed forces (per arrow B in FIG. 7) are applied to the truss 20 along the upper chord 22. Such centrally-located downwardly-directed loading forces are normally applied, such as by roofing components, air handling equipment (neither shown) or otherwise. Additionally, regardless of the extent to which the trimmable end 34A is sawn off, ie. trimmed, the remaining portion of trimmable end 34A (whether of at least the full length of distance "X" or even longer) is still of sufficient strength to undergo the high force loading (per arrow A) created on the lower chord 24 and the lower chord extension 24A.

Also seen in FIG. 7 is a central square-shaped area or so-called central free area 82, as formed by two vertical supports 84 secured at their respective ends to the upper and lower chords 22, 24, and including a single diagonal web 86. When desired, the presence of the central free area 82 is to permit removal of diagonal web 86 in those applications where duct work or other mechanical structures (none shown) needs to extend through the central area of truss 20. Thus, by use of the square opening forming the central free area 82, this can be accommodated without affecting the structural integrity of the truss 20 (or of the modified truss 58).

Figure 8:
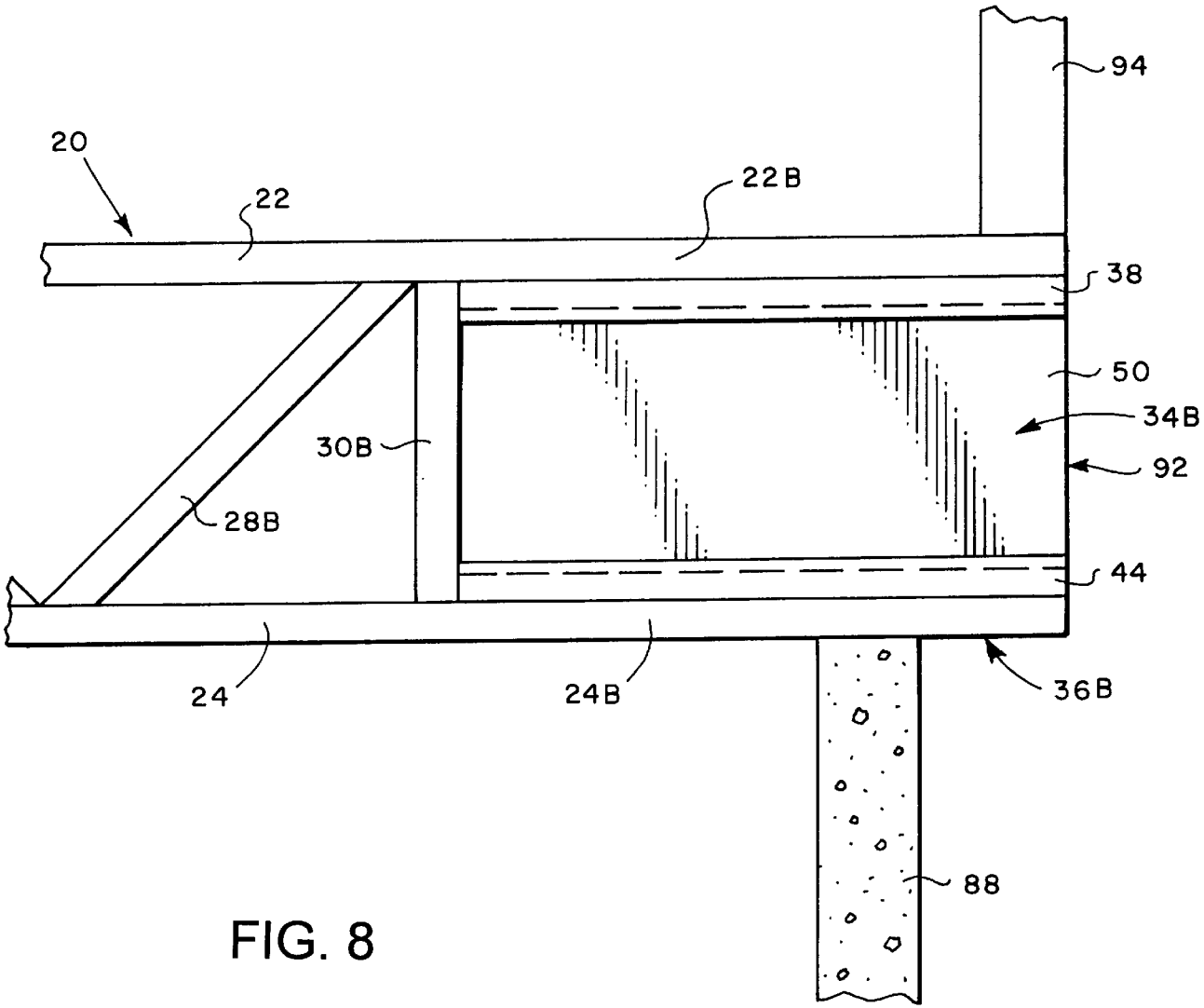
FIG. 8 is a fragmentary elevation view of an improved trimmable truss per FIG. 1, but shown in a cantilevered application.

FIG. 8 depicts an improved trimmable truss 20 used in a cantilevered application. The right trimmable end 36B (similar to right end 36B in FIG. 1) of the improved trimmable truss 20 has its lower chord extension 24B secured to a concrete foundation wall 88. (Alternately, concrete wall 88 could be substituted by a wood-framed wall—such as between a first and second story—not shown). Thus, as seen, the outermost end 92 (ie. right end in FIG. 8) of truss 20 extends beyond concrete wall 88. A wood-framed vertical wall 94 is then positioned adjacent the outermost cantilevered end 92 of truss 20, whereby wall 94 is cantilevered over (ie. built out over) the support wall 88.

Advantageously, in view of the significant structural integrity and support as provided by the trimmable end 36B (and regardless to the length that it is trimmed off), the improved trimmable truss 20 provides ample structural support, even in such cantilevered applications.

The preferred extended, ie. cantilevered, length of the trimmable end 92 beyond the support wall 88 is in the range of 16 to 24 inches. Here again, the extra available cross sectional material present due to the sub-chords 38, 44 of the trimmable insert 34B permits substantial loading on cantilevered truss end 36B. Such loading can be as much as 2,000 pounds vertical load on the outer end 92. Preferably, in the cantilevered application shown in FIG. 8, the thickness of the web 50 of the trimmable insert 34B is preferably approximately ¾ inch for a truss that has a vertical depth in the range of 14 to 16 inches tall. On the other hand, the thickness of the web 50 for the trimmable insert 34B for a trimmable truss 20 used in a typical non-cantilevered residential application, is preferably only approximately ⅜ inch thick for a similar depth truss.

Figures 9, 11:
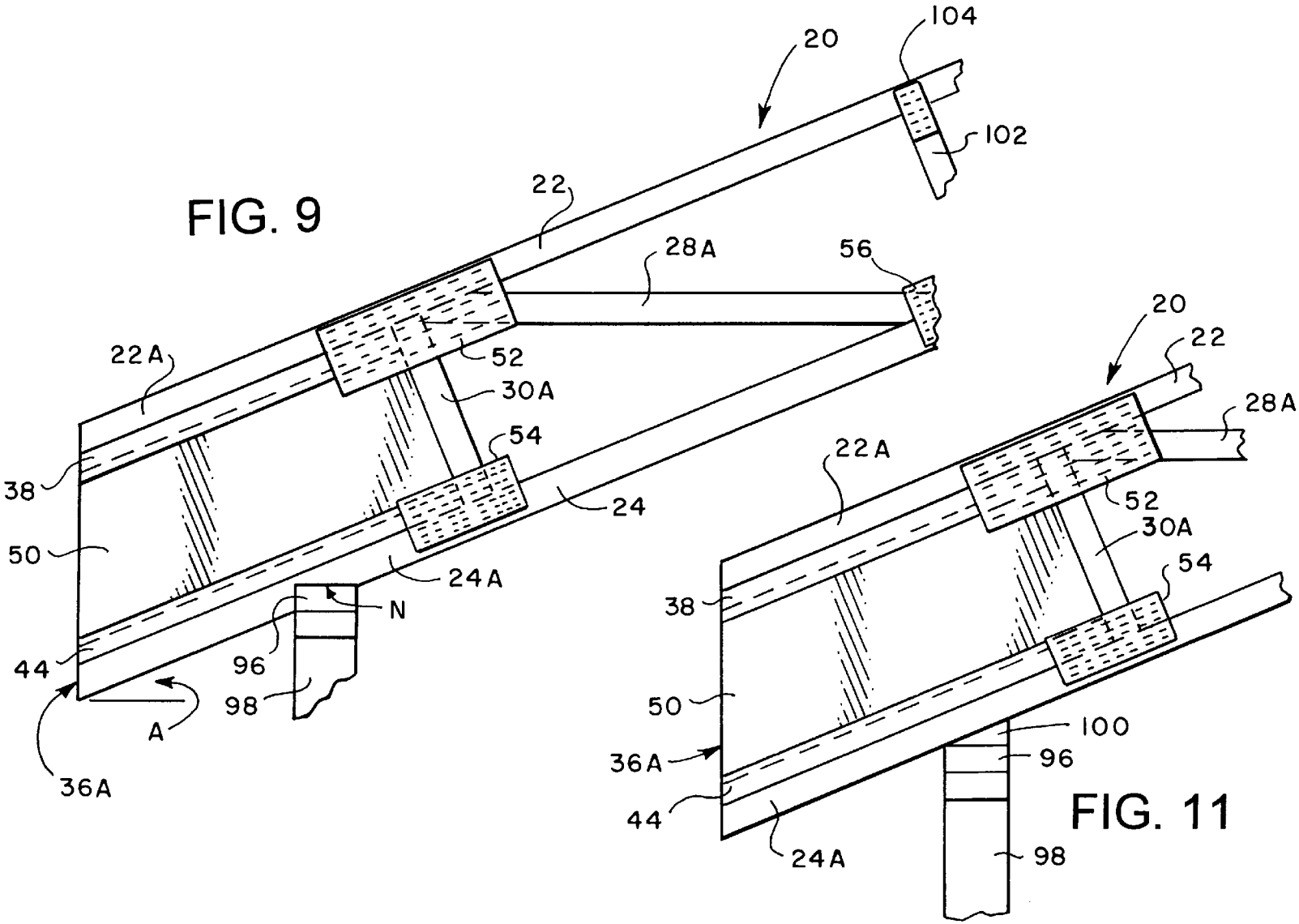
FIGS. 9 and 10 are respective side elevation views of the lower and upper ends of a trimmable truss of FIG. 1, as shown in a "notched" rafter-type application.
FIG. 11 is a side elevation view of an alternate mode of attachment of a trimmable truss in a rafter application.
Figure 10:
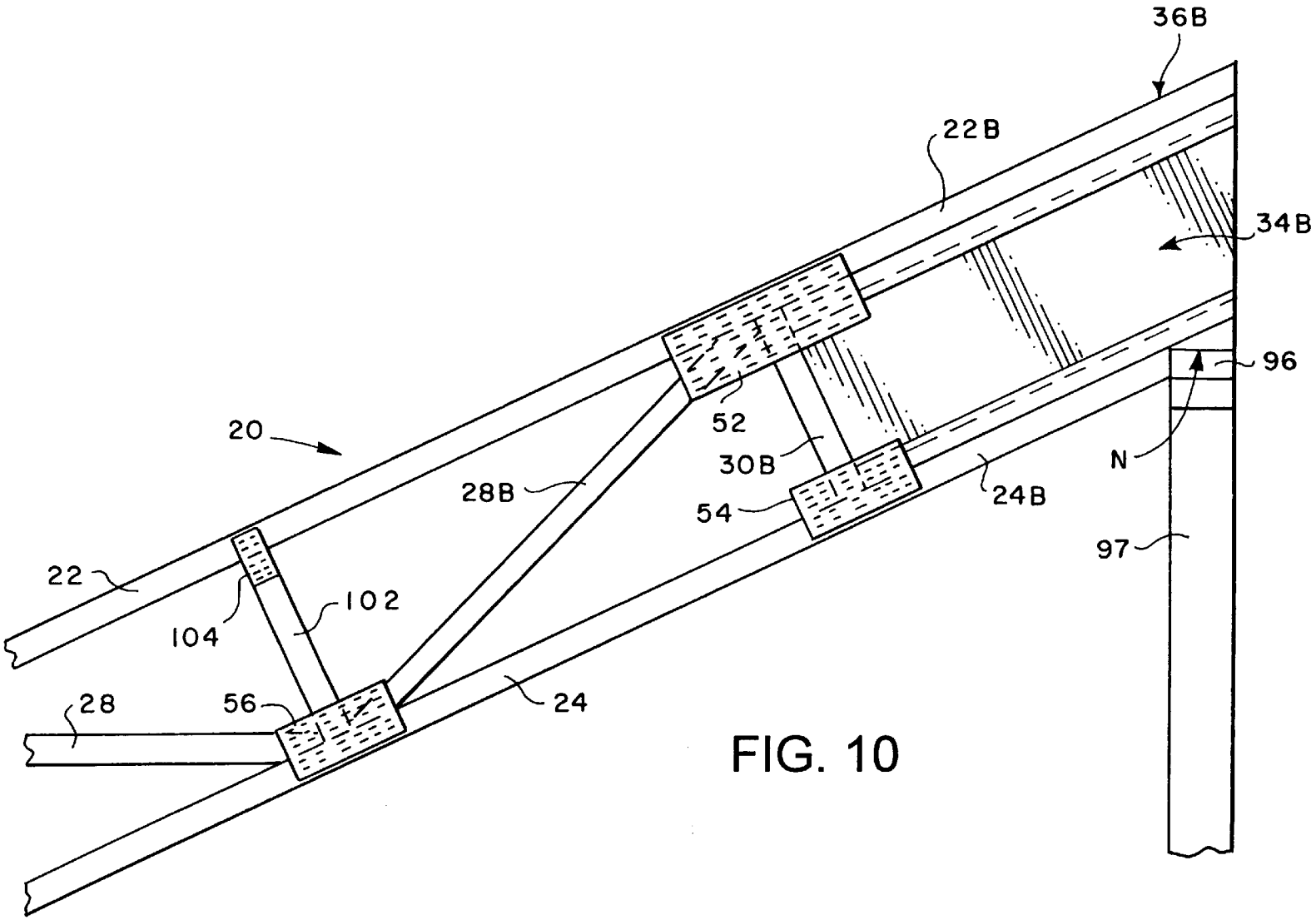

Turning to FIGS. 9 and 10, there is shown an application of the improved trimmable truss 20 of the present invention where it is used in a so-called "notched" rafter application, such as would be used for the roof rafters on a front-to-back split house design. Alternatively, this "notched" type application could be used in a building design where there is a cathedral ceiling having the same pitch as the outside of the building. As seen in FIG. 10, the lower portion of lower chord extension 24A of the trimmable truss 20 is formed with a notch "N" which sits on the top plate 96 of a sidewall 98. This notching, of truss 20 allows the truss to be used as a rafter, ie. set on an angle A to horizontal.

Because of the specific construction of the end 36A, it can be trimmed off at an angle, ie. not just perpendicular to the chords 22, 24, or at any depth without any additional blocking of the trimmable end 36A and its various components.

Likewise, as seen in FIG. 10, the right trimmable end 36B of trimmable truss 20 can be notched (at N) in its lower chord extension 24B to accept the top plate 96 of a ridge support 97. Again, the outer right end of truss 20 can be trimmed off at any angle without at all affecting the integrity of trimmable end 36B.

Traditional rafters, ie. formed of dimensional lumber, do not allow cross ventilation. However, the present trimmable truss, when used as a rafter as shown in FIGS. 9 and 10, allow installation however desired and still permit cross ventilation, ie. through the truss, due to its open web configuration.

FIG. 11 shows an alternate way to mount a trimmable truss 20 in an angled rafter application, and without the need for any notching of the lower chord extension 24B. That is, a bevel block 100 is used, instead of a notch N, to mount the chord extension 24A of truss 20 to the top plate 96 of sidewall 98.

There is also shown in FIGS. 9 and 10 the use of additional vertical webs 102 which interconnect the upper and lower chords 22, 24 at locations intermediate the vertical web end supports 30A, 30B. The vertical webs 102 are secured respectively to the chords 22, 24 by metal connector plates 104, 56. These supplemental vertical webs 102 can be used in those truss applications where additional support is required to withstand yet additional force loading on the truss.

The improved method of forming a trimmable truss pursuant to the present invention includes the following steps. First, two elongated chords, ie. an upper chord and lower chord, of sufficient length to create the required overall trimmable truss, are aligned parallel to one another. Second, a series of diagonally-aligned, oppositely-directed web members, with or without vertical webs, are interconnected between the chords to separate and support the same, care taken to make sure that each end diagonal web member is placed in an upwardly-aligned position. Third, vertical web members are placed interiorly of the respective ends of the upper and lower chords adjacent the terminal diagonal webs, and positioned a sufficient distance inwardly of the chord's ends to create a trimmable truss end section having an insert opening. Fourth, a separate trimmable insert is secured into each insert opening, each trimmable insert taking the form preferably of either a wooden I-beam member or a glued laminated beam section. Fifth, upper and lower metal connector plates are applied to both sides of the respective ends of the truss adjacent the vertical members, the plates being so positioned as to overlap a substantial distance onto the trimmable end to thereby prevent trimming of the trimmable end too closely adjacent the end vertical web member.

In commercial applications, the loading, ie. the so-called end reaction design load, on the ends of a typical truss can be in the range of approximately 4,000 to 6,000 pounds total load. On the other hand, the end reaction design load for a typical trimmable truss used for residential applications is in the range of only approximately 1,000 to 1,500 pounds total load. It is believed that the present trimmable truss will easily withstand such loading. Further, if desired, the present improved trimmable truss can be further strengthened adjacent the respective trimmable ends through the use of either multiple final vertical members or by multiple end diagonal web members.

From the foregoing, it is believed that those skilled in the art will readily appreciate the unique features and advantages of the present invention over previous types of trimmable trusses. Further, it is to be understood that while the present invention has been described in relation to particular preferred and alternate embodiments as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

What is claimed is:

1. A truss, comprising:

upper and lower chord members extending in generally parallel relationship between opposed ends of said truss;

a plurality of connector members spaced along said truss and extending diagonally between said upper and lower chord members, said connector members interconnecting said upper and lower chord members;

a vertical support member secured between said upper and lower chord members and spaced inwardly from one end of said truss, said upper and lower chord members extending beyond said support member to define an end section of said truss between said support member and said one end, said end section having an insert opening between said upper and lower chord members; and a trimmable member located within said insert opening and having upper and lower sub-chord members which are in generally parallel relationship and a web member interconnecting said upper and lower sub-chord members, said upper sub-chord member being in upwardly facing contact with said upper chord member and said lower sub-chord member being in downwardly facing contact with said lower chord member such that said upper and lower sub-chord members are sandwiched between said upper and lower chord members, said connector members terminating short of said end section so that said upper and lower sub-chord members are not interconnected by said connector members.

2. The truss of claim 1 wherein said web member is a relatively flat sheet, whereby said trimmable member comprises a section of an I-beam.

3. The truss of claim 1 wherein said upper and lower chord members and said upper and lower sub-chord members are each a wooden 2×4 having opposed major surfaces, one of said major surfaces being upwardly facing and the other of said major surfaces being downwardly facing, the downwardly facing major surface of said upper chord member being in facing contact with the upwardly facing major surface of said upper sub-chord member and the upwardly facing major surface of said lower chord member being in facing contact with the downwardly facing major surface of said lower sub-chord member.

4. The truss of claim 1 wherein said trimmable member includes two web members interconnecting said upper and lower sub-chord members.

5. The truss of claim 1 wherein said trimmable member includes a plurality of glued board members interconnecting said upper and lower sub-chord members, whereby said trimmable member comprises a section of a glued laminated beam.

6. The truss of claim 1 wherein said upper and lower chord members and said support member are made of wood, said truss further including plural metal attachment plates attaching said support member to said upper and lower chord members, said attachment plates overlapping a sufficient distance along said upper and lower chord members onto said end section to prevent trimming of said end section too closely adjacent to said support member.

7. The truss of claim 1 wherein said upper and lower chord members and said support member are made of wood, said truss further including plural metal attachment plates attaching said support member to said upper and lower chord members, said attachment plates overlapping a predetermined distance along said upper and lower chord members onto said end section, a ratio of said predetermined distance to an overall length of said end section being in a range from about 1:3 to about 1:6.

8. The truss of claim 1 wherein an outermost one of said connector members which is proximate to said end section extends diagonally downwardly and inwardly from said upper chord to said lower chord, whereby said outermost connector member undergoes tension when said truss is loaded.

9. The truss of claim 1 wherein said connector members terminate at said support member.

10. The truss of claim 1 wherein each of said upper sub-chord member and said lower sub-chord member extends between said support member and said one end.

11. A truss, comprising:

upper and lower chord members extending in generally parallel relationship between opposed ends of said truss;

a plurality of connector members spaced along said truss and extending diagonally between said upper and lower chord members, said connector members interconnecting said upper and lower chord members;

first and second vertical support members secured between said upper and lower chord members and spaced inwardly from respective opposed ends of said truss, said upper and lower sub-chord members extending beyond said support members to define first and second end sections of said truss, said first end section being between said first support member and one end of said truss, said second end section being between said second support member and the other end of said truss, each end section having an insert opening between said upper and lower chord members; and two trimmable members, one of said trimmable members is located within one of said insert openings and each of said trimmable members has upper and lower sub-chord members which are in generally parallel relationship and a web member interconnecting the upper and lower sub-chord members, the upper sub-chord member of each trimmable member being in upwardly facing contact with said upper chord member and the lower sub-chord member of each trimmable member being in downwardly facing contact with said lower chord member, such that said upper and lower sub-chord members are sandwiched between said upper and lower chord members, said connector members being intermediate said first and second end sections so that said upper and lower sub-chord members are not interconnected by said connector members.

12. The truss of claim 11 wherein each web member is a relatively flat sheet, whereby said each trimmable member comprises a section of an I-beam.

13. The truss of claim 11 wherein each of said upper and lower chord members and said upper and lower sub-chord members is a wooden 2×4 having opposed major surfaces, one of said major surfaces being upwardly facing and the other of said major surfaces being downwardly facing, the downwardly facing major surface of said upper chord member being in facing contact with the upwardly facing major surface of each upper sub-chord member and the upwardly facing major surface of said lower chord member being in facing contact with the downwardly facing major surface of each lower sub-chord member.

14. The truss of claim 11 wherein each trimmable member includes two web members interconnecting the upper and lower sub-chord members of said each trimmable member.

15. The truss of claim 11 wherein each trimmable member includes a plurality of glued board members interconnecting the upper and lower sub-chord members of said each trimmable member, whereby said each trimmable member comprises a section of a glued laminated beam.

16. The truss of claim 11 wherein said upper and lower chord members and said support members are made of wood, said truss further including plural metal attachment plates attaching said support members to said upper and lower chord members, said attachment plates overlapping a sufficient distance along said upper and lower chord members onto each end section to prevent trimming of said each end section too closely to the support member which is proximate to said each end section.

17. The truss of claim 11 wherein said upper and lower chord members and said support members are made of wood, said truss further including plural metal attachment plates attaching said support members to said upper and lower chord members, said attachment plates overlapping a predetermined distance along said upper and lower chord members onto each end section, a ratio of said predetermined distance to an overall length of said each end section being in a range from about 1:3 to about 1:6.

18. The truss of claim 11 wherein an outermost one of said connector members which is proximate to each end section extends diagonally downwardly from said upper chord to said lower chord, whereby said outermost ones of said connector members are under tension when said truss is loaded.

19. The truss of claim 11 wherein an outermost one of said connector members which is proximate to said first end section terminates at said first support member and an outermost one of said connector members which is proximate to said second end section terminates at said second support member.

20. The truss of claim 11 wherein the upper sub-chord member and the lower sub-chord member of one trimmable member extends between said one end of said truss and said first support member and the upper sub-chord member and the lower sub-chord member of the other trimmable member extends between said other end of said truss and said second support member.

* * * * *